US005733175A

United States Patent [19]

Leach

[11] Patent Number: 5,733,175

[45] Date of Patent: Mar. 31, 1998

[54] POLISHING A WORKPIECE USING EQUAL VELOCITY AT ALL POINTS OVERLAPPING A POLISHER

[76] Inventor: Michael A. Leach, 345 Sheridan #204, Palo Alto, Calif. 94306

[21] Appl. No.: 232,375

[22] Filed: Apr. 25, 1994

[51] Int. Cl.[6] ..... B24B 1/00

[52] U.S. Cl. ..... 451/41; 451/63; 451/270; 451/288

[58] Field of Search ..... 451/41, 63, 270, 451/283, 285, 287, 288

[56] References Cited

U.S. PATENT DOCUMENTS

| | | | |
|---|---|---|---|
| 653,531 | 7/1900 | Richmond et al. . | |
| 1,513,813 | 11/1924 | Hill et al. . | |
| 1,899,463 | 2/1933 | Howard . | |
| 2,405,417 | 8/1946 | Fruth . | |
| 2,493,206 | 1/1950 | Okey . | |
| 2,530,530 | 11/1950 | Littlefield . | |
| 2,536,444 | 1/1951 | Hamilton . | |
| 2,687,603 | 8/1954 | White . | |
| 2,733,562 | 2/1956 | Drummond . | |
| 2,869,294 | 1/1959 | Boettcher et al. . | |
| 2,992,519 | 7/1961 | Pearson . | |
| 2,998,680 | 9/1961 | Lipkins . | |
| 3,032,937 | 5/1962 | Day et al. . | |
| 3,050,910 | 8/1962 | Lichtenfeld . | |
| 3,063,206 | 11/1962 | Meyerhoff et al. . | |
| 3,093,937 | 6/1963 | Balamuth et al. . | |
| 3,110,988 | 11/1963 | Boettcher . | |
| 3,111,791 | 11/1963 | Harris et al. . | |
| 3,292,312 | 12/1966 | Snyder | 451/288 |
| 3,304,662 | 2/1967 | Boettcher . | |
| 3,374,582 | 3/1968 | Boettcher . | |
| 3,535,830 | 10/1970 | Keefe et al. | 451/288 |

(List continued on next page.)

FOREIGN PATENT DOCUMENTS

| | | |
|---|---|---|
| 0 623 423 A1 | 11/1994 | European Pat. Off. . |
| 3-221368 A | 9/1991 | Japan . |

OTHER PUBLICATIONS

Kolenkow et al., "Chemical–Mechanical Wafer Polishing and Planarization in Batch Systems", Solid State Technology, pp. 112–114, Jun. 1992.

Patrick et al., "Application of Chemical Mechanical Polishing to the Fabrication of VLSI Circuit Interconnections", J. Electrochem. Soc., vol. 138, No. 6, pp. 1778–1784, Jun. 1991.

(List continued on next page.)

*Primary Examiner*—M. Rachuba

*Attorney, Agent, or Firm*—Skjerven, Morrill, MacPherson, Franklin & Friel; Alan H. MacPherson; Omkar K. Suryadevara

[57] ABSTRACT

A polishing machine for polishing a single side (e.g. a circuit side) of a workpiece (e.g. a semiconductor wafer) includes two platens. A first platen can be a workpiece-holding platen having slots or other structure for holding wafers or other workpieces. The second platen is a polishing platen and is covered with a polishing pad or other material used for polishing, e.g. glass or metal polishing. The two platens have laterally spaced axes of rotation such that, from a top view, the right side of one platen overlaps the left side of the other platen or vice versa. The two platens are both rotated at the same angular velocity i.e. at the same revolutions per minute (RPM) and both clockwise or both counterclockwise, and the two platens overlap such that the differences in velocity (i.e., relative velocity) between overlapping points on the two platens across a workpiece held on the first platen is constant. A second embodiment of the polishing machine uses one or more polishing rollers, instead of the polishing platen described above. In the second embodiment as well, a uniform relative velocity is obtained at overlapping points on the two platens across the workpiece when the angular velocity of the workpiece-holding platen is equal to the angular velocity of the polishing roller about a lateral axis perpendicular to the longitudinal axis of the polishing roller. The polishing roller is simultaneously rotated about the longitudinal axis (which is perpendicular to the lateral axis) to increase or decrease the uniform relative velocity with which the workpiece is polished.

31 Claims, 8 Drawing Sheets

U.S. PATENT DOCUMENTS

| | | | |
|---|---|---|---|
| 3,559,346 | 2/1971 | Paola . | |
| 3,603,042 | 9/1971 | Boettcher . | |
| 3,611,654 | 10/1971 | Weber et al. . | |
| 3,628,291 | 12/1971 | Visconti . | |
| 3,631,634 | 1/1972 | Weber . | |
| 3,684,466 | 8/1972 | Petrone . | |
| 3,685,213 | 8/1972 | Rampe . | |
| 3,691,694 | 9/1972 | Goetz et al. . | |
| 3,699,722 | 10/1972 | Davidson et al. | 451/288 |
| 3,731,435 | 5/1973 | Boettcher et al. . | |
| 3,748,677 | 7/1973 | Frank et al. . | |
| 3,813,825 | 6/1974 | Weber et al. . | |
| 3,823,515 | 7/1974 | Coes, Jr. . | |
| 3,838,542 | 10/1974 | Hodges . | |
| 3,888,053 | 6/1975 | White et al. . | |
| 3,906,678 | 9/1975 | Roth . | |
| 3,998,673 | 12/1976 | Chow | 148/175 |
| 4,009,540 | 3/1977 | Uijen . | |
| 4,010,583 | 3/1977 | Highberg . | |
| 4,079,169 | 3/1978 | Nigh et al. | 428/636 |
| 4,085,549 | 4/1978 | Hodges . | |
| 4,132,037 | 1/1979 | Bonora . | |
| 4,141,180 | 2/1979 | Gill et al. . | |
| 4,144,099 | 3/1979 | Edmonds et al. | 148/1.5 |
| 4,193,226 | 3/1980 | Gill et al. . | |
| 4,194,324 | 3/1980 | Bonora et al. . | |
| 4,195,323 | 3/1980 | Lee | 360/113 |
| 4,208,760 | 6/1980 | Dexter | 15/302 |
| 4,239,567 | 12/1980 | Winings | 156/154 |
| 4,258,508 | 3/1981 | Wilson et al. . | |
| 4,276,114 | 6/1981 | Takano et al. | 156/645 |
| 4,313,284 | 2/1982 | Walsh . | |
| 4,321,284 | 3/1982 | Yakushiji | 427/89 |
| 4,321,641 | 3/1982 | Lee | 360/126 |
| 4,328,462 | 5/1982 | Jensen | 324/229 |
| 4,373,991 | 2/1983 | Banks . | |
| 4,393,628 | 7/1983 | Ottman et al. . | |
| 4,410,395 | 10/1983 | Weaver et al. | 156/662 |
| 4,412,886 | 11/1983 | Sakaguchi et al. | 156/645 |
| 4,417,945 | 11/1983 | Komatsuzaki | 156/639 |
| 4,435,247 | 3/1984 | Basi et al. | 156/636 |
| 4,450,652 | 5/1984 | Walsh | 51/131.4 |
| 4,466,218 | 8/1984 | Ottman et al. . | |
| 4,471,579 | 9/1984 | Bovensiepen . | |
| 4,489,484 | 12/1984 | Lee | 29/603 |
| 4,492,717 | 1/1985 | Pliskin et al. | 427/96 |
| 4,498,258 | 2/1985 | Ishimura . | |
| 4,512,113 | 4/1985 | Budinger . | |
| 4,520,596 | 6/1985 | Otto et al. . | |
| 4,524,127 | 6/1985 | Kane | 430/321 |
| 4,554,717 | 11/1985 | Vig et al. | 29/25.35 |
| 4,579,760 | 4/1986 | Hause et al. | 428/66 |
| 4,588,473 | 5/1986 | Hisatomi et al. | 156/645 |
| 4,593,495 | 6/1986 | Kawakami et al. . | |
| 4,607,496 | 8/1986 | Nagaura | 62/64 |
| 4,653,231 | 3/1987 | Cronkhite et al. . | |
| 4,665,568 | 5/1987 | Carcey . | |
| 4,667,446 | 5/1987 | Imahashi . | |
| 4,671,851 | 6/1987 | Beyer et al. | 156/645 |
| 4,680,893 | 7/1987 | Cronkite et al. . | |
| 4,685,937 | 8/1987 | Hori et al. . | |
| 4,692,223 | 9/1987 | Lampert et al. | 204/34.5 |
| 4,695,294 | 9/1987 | Korzekwa et al. . | |
| 4,708,891 | 11/1987 | Ito et al. | 427/245 |
| 4,722,130 | 2/1988 | Kimura et al. | 29/413 |
| 4,748,775 | 6/1988 | Imahashi . | |
| 4,753,838 | 6/1988 | Kimura et al. | 428/91 |
| 4,775,550 | 10/1988 | Chu et al. | 427/38 |
| 4,776,087 | 10/1988 | Cronin et al. | 29/828 |
| 4,789,648 | 12/1988 | Chow et al. | 437/225 |
| 4,793,895 | 12/1988 | Kaanta et al. | 156/627 |
| 4,811,522 | 3/1989 | Gill, Jr. . | |
| 4,854,083 | 8/1989 | Ishizuka et al. . | |
| 4,874,463 | 10/1989 | Koze et al. | 156/645 |
| 4,875,309 | 10/1989 | Long, III . | |
| 4,879,257 | 11/1989 | Patrick | 437/195 |
| 4,889,493 | 12/1989 | Otsuki et al. | 437/265 |
| 4,889,586 | 12/1989 | Noguchi et al. | 156/636 |
| 4,907,062 | 3/1990 | Fukushima | 375/75 |
| 4,907,371 | 3/1990 | Shoda et al. . | |
| 4,910,155 | 3/1990 | Cote et al. . | |
| 4,916,868 | 4/1990 | Wittstock . | |
| 4,918,870 | 4/1990 | Torbert et al. . | |
| 4,934,102 | 6/1990 | Leach et al. . | |
| 4,934,103 | 6/1990 | Campergue et al. . | |
| 4,940,507 | 7/1990 | Harbarger | 156/636 |
| 4,944,119 | 7/1990 | Gill, Jr. et al. . | |
| 4,944,836 | 7/1990 | Beyer et al. | 156/645 |
| 4,954,141 | 9/1990 | Takiyama et al. . | |
| 4,956,022 | 9/1990 | Mahmoud | 134/41 |
| 4,956,313 | 9/1990 | Cote et al. | 437/203 |
| 4,960,485 | 10/1990 | Ichinose et al. | 156/556 |
| 4,973,563 | 11/1990 | Prigge et al. | 437/225 |
| 4,974,370 | 12/1990 | Gosis . | |
| 4,985,990 | 1/1991 | Cronin et al. | 29/852 |
| 4,986,035 | 1/1991 | Lambot . | |
| 4,989,345 | 2/1991 | Gill, Jr. | 34/58 |
| 4,992,135 | 2/1991 | Doan | 156/636 |
| 5,020,283 | 6/1991 | Tuttle . | |
| 5,032,544 | 7/1991 | Ito et al. | 437/228 |
| 5,036,015 | 7/1991 | Sandhu et al. | 437/8 |
| 5,036,630 | 8/1991 | Kaanta et al. . | |
| 5,038,524 | 8/1991 | Moulin . | |
| 5,044,128 | 9/1991 | Nakano . | |
| 5,051,378 | 9/1991 | Yagi et al. | 437/225 |
| 5,055,158 | 10/1991 | Gallagher et al. | 156/643 |
| 5,069,002 | 12/1991 | Sandhu et al. . | |
| 5,071,785 | 12/1991 | Nakazato et al. | 437/62 |
| 5,071,792 | 12/1991 | Van Vonno et al. | 437/227 |
| 5,073,518 | 12/1991 | Doan et al. | 437/180 |
| 5,077,234 | 12/1991 | Scoopo et al. | 437/67 |
| 5,078,801 | 1/1992 | Malik | 134/29 |
| 5,081,421 | 1/1992 | Miller et al. | 324/671 |
| 5,081,733 | 1/1992 | Kudo | 15/77 |
| 5,081,796 | 1/1992 | Schultz | 451/8 |
| 5,084,419 | 1/1992 | Sakao | 437/228 |
| 5,094,037 | 3/1992 | Hakomori et al. . | |
| 5,095,661 | 3/1992 | Gill, Jr. et al. . | |
| 5,096,854 | 3/1992 | Saito et al. | 437/225 |
| 5,097,630 | 3/1992 | Maeda et al. . | |
| 5,101,602 | 4/1992 | Hashimoto . | |
| 5,104,828 | 4/1992 | Morimoto et al. | 437/225 |
| 5,110,428 | 5/1992 | Prigge et al. | 204/129.3 |
| 5,114,875 | 5/1992 | Baker et al. | 437/62 |
| 5,123,218 | 6/1992 | Karlsrud . | |
| 5,127,196 | 7/1992 | Morimoto et al. . | |
| 5,128,281 | 7/1992 | Dyer et al. | 437/225 |
| 5,131,110 | 7/1992 | Hadgis . | |
| 5,131,979 | 7/1992 | Lawrence | 156/655 |
| 5,132,617 | 7/1992 | Leach et al. | 324/207.16 |
| 5,137,544 | 8/1992 | Medellin . | |
| 5,139,571 | 8/1992 | Deal et al. | 106/3 |
| 5,144,711 | 9/1992 | Gill . | |
| 5,152,857 | 10/1992 | Ito et al. | 156/153 |
| 5,157,876 | 10/1992 | Medellin . | |
| 5,157,877 | 10/1992 | Hashimoto . | |
| 5,169,491 | 12/1992 | Doan | 156/636 |
| 5,177,908 | 1/1993 | Tuttle . | |
| 5,181,342 | 1/1993 | Haney . | |
| 5,181,985 | 1/1993 | Lampert et al. | 156/635 |
| 5,187,899 | 2/1993 | Rhoades . | |
| 5,187,901 | 2/1993 | Karlsrud . | |

| | | | |
|---|---|---|---|
| 5,191,738 | 3/1993 | Nakazato et al. . | |
| 5,193,316 | 3/1993 | Olmstead . | |
| 5,196,353 | 3/1993 | Sandhu et al. | 437/8 |
| 5,197,230 | 3/1993 | Simpfendorfer et al. . | |
| 5,203,119 | 4/1993 | Cole . | |
| 5,205,077 | 4/1993 | Wittstock . | |
| 5,205,082 | 4/1993 | Shendon et al. . | |
| 5,209,023 | 5/1993 | Bizer . | |
| 5,213,655 | 5/1993 | Leach et al. | 156/627 |
| 5,216,842 | 6/1993 | Phillips . | |
| 5,216,843 | 6/1993 | Breivogel . | |
| 5,217,566 | 6/1993 | Pasch et al. | 156/636 |
| 5,222,329 | 6/1993 | Yu . | |
| 5,225,358 | 7/1993 | Pasch | 437/33 |
| 5,226,758 | 7/1993 | Tanaka et al. . | |
| 5,226,930 | 7/1993 | Sasaki . | |
| 5,227,339 | 7/1993 | Kishii | 437/225 |
| 5,229,331 | 7/1993 | Doan et al. | 437/228 |
| 5,232,875 | 8/1993 | Tuttle et al. . | |
| 5,234,867 | 8/1993 | Schultz et al. . | |
| 5,234,868 | 8/1993 | Cote | 437/225 |
| 5,240,552 | 8/1993 | Yu et al. | 156/636 |
| 5,241,792 | 9/1993 | Naka et al. . | |
| 5,242,524 | 9/1993 | Leach et al. | 156/345 |
| 5,245,790 | 9/1993 | Jerbic . | |
| 5,245,794 | 9/1993 | Salugsugan . | |
| 5,246,525 | 9/1993 | Sato | 156/345 |
| 5,255,474 | 10/1993 | Gawa et al. . | |
| 5,264,010 | 11/1993 | Brancaleoni et al. . | |
| 5,265,378 | 11/1993 | Rostoker . | |
| 5,267,418 | 12/1993 | Currie et al. . | |
| 5,269,102 | 12/1993 | Wood . | |
| 5,270,241 | 12/1993 | Dennison et al. | 437/52 |
| 5,274,960 | 1/1994 | Karlsrud . | |
| 5,276,999 | 1/1994 | Bando . | |
| 5,282,289 | 2/1994 | Hasegawa et al. | 15/21.1 |
| 5,283,208 | 2/1994 | Lorsung et al. | 437/228 |
| 5,283,989 | 2/1994 | Hisasue et al. . | |
| 5,287,658 | 2/1994 | Attanasio et al. . | |
| 5,290,396 | 3/1994 | Schoenborn et al. | 156/636 |
| 5,297,361 | 3/1994 | Baldy et al. . | |
| 5,297,364 | 3/1994 | Tuttle . | |
| 5,299,393 | 4/1994 | Chandler et al. . | |
| 5,301,471 | 4/1994 | Fisher et al. . | |
| 5,302,233 | 4/1994 | Kim et al. | 156/636 |
| 5,303,511 | 4/1994 | Tsuchiya et al. . | |
| 5,305,554 | 4/1994 | Emken et al. . | |
| 5,305,555 | 4/1994 | Luedeke et al. . | |
| 5,307,593 | 5/1994 | Lucker et al. . | |
| 5,317,778 | 6/1994 | Kudo et al. | 15/88.3 |
| 5,320,706 | 6/1994 | Blackwell | 156/636 |
| 5,325,636 | 7/1994 | Attanasio et al. . | |
| 5,329,732 | 7/1994 | Karlsrud et al. . | |
| 5,332,467 | 7/1994 | Sune et al. | 156/636 |
| 5,335,453 | 8/1994 | Baldy et al. . | |
| 5,335,457 | 8/1994 | Matsuda et al. . | |
| 5,337,015 | 8/1994 | Lustig et al. | 324/671 |
| 5,340,370 | 8/1994 | Cadien et al. . | |
| 5,341,602 | 8/1994 | Foley . | |
| 5,341,608 | 8/1994 | Mains, Jr. . | |
| 5,350,428 | 9/1994 | Leroux et al. | 29/25.01 |
| 5,361,545 | 11/1994 | Nakamura | 451/287 |
| 5,435,772 | 7/1995 | Yu | 451/63 |

OTHER PUBLICATIONS

Beppu et al., "Using CMP for Planarization Polishing of Interlayer Dielectric Film", Semiconductor World, pp. 58–62, Jan. 1994.

Watanabe et al., "Charateristics and Trends of CMP Equipment", Denshi Zairyo, pp. 91–96, Mar. 1994.

Kurobe and Imanaka, "Novel Surface Finishing Technique Controlled by Magnetic/Electric Field", Proceedings of the 5th International Conference on Production Engineering Tokyo, pp. 259–264, 1984.

Mutter, "Choice Stop Material for Chemical/Mechanical Polish Planarization", IBM Technical Disclosure Bulletin, vol. 27, No. 8, p. 4642, Jan. 1985.

Beyer et al., "Glass Planarization by Stop–Layer Polishing", IBM Technical Disclosure Bulletin, vol. 27, No. 8, pp. 4709–4710, Jan. 1985.

Garroux and Zunino, "Reducing the Wafer Deformation Induced by Polishing", IBM Technical Disclosure Bulletin, vol. 28, No. 4, pp. 1635–1636, Sep. 1985.

Ashley et al., "Planarization of Metal Substrates for Solar Mirrors", Mat. Res. Soc. Symp. Proc., vol. 121, pp. 635–638, 1988.

Daubenspeck et al., "Planarization of ULSI Topography Over Variable Pattern Densities", IBM General Technology Division, 2 pages, Dec. 1988.

Suzuki et al., "Study on Magnetic Field–Assisted Polishing–Application to a Spherical Surface", JSPE, pp. 1053–1058, 1989.

Suzuki et al., "Magnetic Field–Assisted Polishing–Application to a Curved Surface", Precision Engineering, vol. 11, No. 4, pp. 197–202, Oct. 1989.

Kaanta et al., "Dual Damascene: A ULSI Wiring Technology", IEEE VMIC Conference, pp. 144–152, Jun. 11–12, 1991.

Homma et al., "Fully Planarized Multilevel Interconnection Using Selective $SIO_2$ Deposition", NEC Res. & Develop., vol. 32, NO. 3, pp. 315–322, Jul. 1991.

Warnack, "A Two–Dimensional Process Model for Chemimechanical Polish Planarization", J. Electrochem. Soc., vol. 138, No. 8, pp. 2398–2402, Aug. 1991.

Hayashi et al., "A New Abrasive–Free, Chemical–Mechanical–Polishing Technique for Aluminum Metallization of ULSI Devices", IEEE IEDM, pp. 976–978, 1992.

Landis et al., "Integration of Chemical–Mechanical Polishing into CMOS Integrated Circuit Manufacturing", Thin Solid Films, vol. 220, pp. 1–7, 1992.

Singer, "Searching for Perfect Planarity", Semiconductor International, pp. 44–48, Mar. 1992.

Yu et al., "Dishing Effects in a Chemical Mechanical Polishing Planarization Process for Advanced Trench Isolation", Appl. Phys. Lett., vol. 61, No. 11, pp. 1344–1346, Sep. 14, 1992.

Morimoto et al., "Characterization of Chemical–Mechanical Polishing of Inter–Metal Dielectric Film", Proceedings of the Symposia on Interconnects, Contact Metallization, and Multilevel Metallization and Reliability for Semiconductor Devices, Interconnects, and Thin Insulator Materials, pp. 122–130, 1993.

Runnels, "Modeling the Effect of Polish Pad Deformation on Wafer Surface Stress Distributions During Chemical–Mechanical Polishing", Proceedings of the Symposia on Interconnects, Contact Metallization, and Multilevel Metallization and Reliability for Semiconductor Devices, Interconnects, and Thin Insulator Materials, pp. 110–121, 1993.

Yu et al., "A Statistical Polishing Pad Model For Chemical–Mechanical Polishing", IEEE IEDM, pp. 865–868, 1993.

Cook and Marty, "Planarization by Polishing: New Uses for an Old Technology", 14 pages, Feb. 24, 1993.

Iscoff, "CMP Takes a Global View", Semiconductor International, pp. 72–74, 76, and 78, May 1993.

"CMP Application to Manufacturing Has Started, It Covers ASI and DRAM", Nikkei Microdevices, pp. 50–55, 1994.
English translation of "CMP Application to Manufacturing Has Started, It Covers ASI and DRAM", Nikkei Microdevices, pp. 50–55, 1994. (translation 12 pages).
Yu et al., "Combined Asperity Contact and Fluid Flow Model for Chemical–Mechanical Polishing", IEEE NUPAD V, pp. 29–32, 1994.
Bajaj et al., "Effect of Polishing Pad Material Properties on Chemical Mechanical Polishing (CMP) Processes", Mat. Res. Soc. Symp. Proc., vol. 337, pp. 637–644, 1994.
Howland et al., "Meterology and Inspection Techniques for CMP Applications, Semicon West", pp. 1–27, 1994.
Stell et al., "Planarization Ability of Chemical Mechanical Planarization (CMP) Processes", Mat. Res. Soc. Symp. Proc., vol. 337, pp. 151–156, 1994.
Karaki–Doy et al., "Global Planarization Technique by High–Precision Polishing and Its Charateristics", pp. 174–180, Undated, believed to be before Apr., 1994.
Yuan et al., "A Novel Wafer Carrier Ring Design Minimizes Edge Over–Polishing Effects for Chemical Mechanical Polishing", 3 pages, Undated, believed to be before Apr. 1994.
Marty, "Polishing Materials and Their Relation to the CMP Process", pp. 1–10, Undated, believed to be before Apr. 1994.
Ketchen et al., "Sub–μm, Planarized, Nb–$AlO_x$–Nb Josephson Process for 125 mm Wafers Developed in Partnership with Si Technology", 3 pages, Undated, believed to be before Apr. 1994.
Beyer and Pliskin, "Borosilicate Glass Trench Fill", IBM Technical Disclosure Bulletin, vol. 27, No. 2, pp. 1245–1247, Jul. 1984.
Kaanta et al., "Submicron Wiring Technology with Tungsten and Planarization", Proceeding of IEDM, pp. 1–8, Dec. 1987.
Ives and Leung, "Noncontact Laminar–flow Polishing for GaAs", Rev. Sci. Instrum., vol. 59, No. 1, pp. 172–175, Jan. 1988.
Zingg et al., "Thinning Techniques for 1 μm ELO–SOI", IEEE SOS/SOI Technology Workshop Proceedings, p. 52, Oct. 3–5, 1988.
Cote et al., "Mechanical Polish Clean Up After M2 CVD W Blanket Etch for CMOS DRAM", IBM Technical Disclosure Bulletin, vol. 31, No. 12, pp. 189–190, May 1989.
"Method for Elimination of Scratches in Polished Damascene Conductors", Research Disclosure, No. 322, 1 page, Feb. 1991.
Uttecht and Geffken, "A Four–Level–Metal Fully Planarized Interconnect Technology for Dense High Performance Logic and SRAM Applications", IEEE VMIC Conference, pp. 20–26, Jun. 11–12, 1991.
Kaufman et al., "Chemical–Mechanical Polishing for Fabricating Patterned W Metal Features as Chip Interconnects", J. Electrochem. Soc., vol. 138, No. 11, pp. 3460–3465, Nov. 1991.
Roehl et al., "High Denisty Damascene Wiring and Borderless Contacts for 64 M DRAM", IEEE VMIC Conference, pp. 22–28, Jun. 9–10, 1992.
Joshi, "A New Damascene Structure for Submicrometer Interconnect Wiring", IEEE Electron Device Letters, vol. 14, No. 3, pp. 129–132, Mar. 1993.
Search Report Results, "Chemical Mechanical Polishing–Patents", pp. 1–44.
Search Report Results, "Chemical Mechanical Polishing–Technical", pp. 1–53.
Gonnella and Shen, "Fine Pollishing Abrasive Wheel Using Flexible High–Density Urethane Foams", IBM Technical Disclosure Bulletin, vol. 25, No. 3B, pp. 1604–1605, Aug. 1982.
LaRose and Sherk, "Abrasive for the Production of Anti–Glare Surfaces on Displays", IBM Technical Disclosure Bulletin, vol. 25, No. 11A, p. 5804, Apr. 1983.
Biver et al. "Method of Microroughening the $Al_2O_3$ TiC Substrate of Magnetic Sliders", IBM Technical Disclosure Bulletin, vol. 26, No. 7A, Dec. 1983.
Koshiyama, "Lapping and Polishing Wafers for Modern Monolithic Microcircuits", Microelectronic Manufacturing and Testing, pp. 19–20. Oct. 1988.
Sadagopan, "Garnet Substrate Surface Preparation", IBM TEchnical Disclosure Bulletin, vol. 15, No. 11, p. 3527, Apr. 1973.
McLaughlin, "Cutting with Wires and Polishing with Diamonds", SME'Westec, pp. 158–167, Mar. 1979.
Brandmyer and Vig, "Chemical polishing in Etching Solutions That Contain Surfactants", 39th Annual Frequency Control Symposium, pp. 276–281, 1985.
Oliker et al., "Machining of Plastics with Magnetoabrasive Powders", translated from Poroshkovaya Metallurgiya, No. 5 (269), pp. 70–74, May 1985.
Bhushan and Martin, "Accelerated Wear Test Using Magnetic–Particle Slurries", STLE Tribology Transactions, vol. 31, No. 2, pp. 228–238, May 1985.
Maiboroda and Shlyuko, "Motion of a Ferromagnetic Powder During Magnetoabrasive Polishing", translated from Poroshkovaya Metallurgiya, No. 8(296), pp. 3–8, Aug. 1987.
Stowers et al., "Review of Precision Surface Generating Process and their Potential Application to the Fabrication of Large Optical Components", SPIE, vol. 966, Advances in Fabrication and Metrology for Optics and Large Optics, pp. 62–73, 1988.
Kuneida et al., "Robot–Polishing of Curved Surface with Magnetically Pressed Polishing Tool", JSPE, pp. 125–131, 1988.
Fielder, "Lixiviation Effects in Glass Polishing", SPIE, vol. 1128, Glasses for Optoelectronics, pp. 45–47, 1989.
Natishan et al., "Surface Preparation of Aluminam for Ion Implantation", Metallography, vol. 23, pp. 21–26, 1989.
Brown and Fuchs, "Shear Mode Grinding", Proceedings of the 43rd Annual Symposium on Frequency Control–1989, pp. 606–610, May 31–Jun. 2, 1989.
Shinmura, "Development of a Unit System Magnetic Abrasive Finishing Apparatus using Permanent Magnets", Bull. Japan Soc. of Prec. Engg., vol. 23, No. 4, pp. 313–315, Dec. 1989.
"Ceramic Planarizing Layer", Research Disclosure, No. 319, 1 page, Nov. 1990.
Cook, "Chemical Processes in Glass Polishing", Journal of Non–Crystalline Solids, vol. 120, pp. 152–171, 1990.
Iler, *The Chemistry of Silica*, pp. 3–5, 48–49, 58–65, 370–379, 666–669, 672–679, and 720–725, Undated, believed to be before Apr. 1994.
Ruben, "Magnetabrasive Finishing: A Method for the Machining of Complicated Shaped Workpieces" pp. 239–256, Undated, believed to be before Apr. 1994.
Namba, "Mechanism of Float Polishing", pp. TuB–A2–1 to TuB–A2–4, Undated, believed to be before Apr. 1994.
Kumagai et al., "Mechano–Chemical Polishing of Titanium", pp. 2555–2564, Undated, believed to be before Apr. 1994.

Malcome–Lawes et al. "A Capacitance Method for Monitoring the Rate of Polishing of Self–Polishing in the Laboratory", Polymer Testing, vol. 9, pp. 91–101, 1990.
Aoki et al., "Novel Electrolysis–Ionized–Water Cleaning Technique for the Chemical–Mechanical Polishing (CMP) Process", 1994 Symposium on VLSI Technology Digest of Technical Papers, pp. 79–80, 1994.
Search Results, "Wafer Cleaning–Patents", pp. 1–83.
Search Results, "Wafer Cleaning–Technical", pp. 1–29.
Document "X" under seal.
Document "Y" under seal.
Search Results, Technical Insights Alert, "Advanced Coatings Alert".
Search Results, Teltech Technology, Dossier Service, "Current and Advanced Topics".
Search Results, Teltech, "Low Particle Coatings".

POLISHING A WORKPIECE USING EQUAL VELOCITY AT ALL POINTS OVERLAPPING A POLISHER

FIELD OF THE INVENTION

This invention relates to an apparatus and method for polishing a workpiece, and in particular to an apparatus and method for uniformly polishing a semiconductor wafer on a single side, without reference to the other side of the wafer.

BACKGROUND OF THE INVENTION

Traditionally, integrated circuits are built from a flat circular workpiece, called a blank wafer that is formed of a semiconductor material, such as silicon. Typically, a blank wafer's surface is subdivided into a number of rectangular areas in which a number of images are formed by photolithography. Such a "processed" wafer's images eventually become, after a number of processing steps, integrated circuit die.

Until recently, the use of precision polishing machines in semiconductor integrated circuit manufacture was restricted to the final preparation of blank wafers, after which the blank wafers were used as substrates for manufacturing integrated circuits, without any further polishing. Recently, precision polishing has been used in new processes, subsequent to the final preparation of a blank wafer, i.e. to polish processed wafers during the manufacture of integrated circuits. For instance, U.S. Pat. No. 4,910,155, entitled "Wafer Flood Polishing" granted to Cote et al., issued Mar. 20, 1990, describes a new process of polishing processed wafers during integrated circuit manufacture, using polishing pads adapted from pads used in the final preparation of blank wafers.

The pads used in final preparation were originally designed to polish both sides of a blank wafer (in a process called double-sided polishing) to a predetermined flatness and parallelism specification. The new polishing processes used for processed wafers polish only one side of a wafer, without reference to the other side of the wafer (in a process called single-sided polishing). Many of the new polishing processes and machines remove unwanted protrusions that may be formed on the surface of a processed wafer during integrated circuit manufacture.

A prior art polishing machine 10 (FIG. 1A) has a polishing wheel 12A rotated by a motor 17 through a pulley and belt arrangement 23 and drive shaft 24. Rotation of polishing wheel 12 is stabilized by bearings 19*a* and 19*b* mounted on drive shaft 24. Polishing machine 10 also includes a workpiece holder 13 to fixedly hold one side of a workpiece 22, such as a processed wafer. Workpiece holder 13 is rotated by an arm motor 20 via a gear differential 21. Workpiece holder 13 is also pushed toward polishing wheel 12 by an air cylinder 14 through polishing arm 15, so that workpiece 22 is abraded during relative motion between polishing wheel 12 and workpiece 22.

Typically, polishing wheel 12 and workpiece 22 are rotated in counter-clockwise directions 26 and 25 respectively (FIG. 1B), while workpiece 22 is kept in an interior region of polishing wheel 12 by workpiece holder 13 (FIG. 1A). Frame 11 (FIG. 1A) prevents any misalignment between polishing wheel 12 and workpiece holder 13. Workpiece holder 13 includes a ball joint 16 that allows workpiece holder 13 to gimbal and so compensate for any misalignment between polishing wheel 12 and polishing arm 15 i.e. allows workpiece holder 13 to track the surface of polishing wheel 12.

In practice ball joint 16 does not act freely under the pushing force applied by air cylinder 14. In addition, rotation of polishing wheel 12 imparts to workpiece holder 13 a shear force that is absorbed by ball joint 16. The shear force and the pushing force act together on ball joint 16 to cause a peripheral portion of workpiece 22 to "dive" into polishing pad 18, thereby resulting in overpolishing of the peripheral portion.

Furthermore, polishing arm 15 is often coupled to an automatic workpiece loading station or to a wafer cleaning station or to both. Such stations can transmit motions and forces through the coupling to polishing arm 16, and cause instability of polishing arm 15 thereby requiring frequent realignment of polishing arm 15 with respect to polishing wheel 12. Such a coupling can also cause polishing arm 15 to flex or vibrate during polishing, thereby resulting in nonuniformity across workpiece 22 on completion of the polishing process.

Uniformity of material removal from workpiece 22 also depends on the rotation speeds of workpiece 22 and polishing wheel 12. In theory, an optimization of the rotation speeds can be predicted mathematically. However, in practice finding rotation speeds that result in the most uniform polishing (i.e. removal) rate across workpiece 22 requires trial and error experimentation, for example if an edge of workpiece 22 dives into polishing wheel 12, or due to practical problems, such as hydroplaning.

To compensate for such practical problems, instead of having polishing wheel 12, a polishing machine 65 (FIG. 1C) has a cylindrical roller 61 that rotates about a longitudinal axis 62 in direction 63 and pushes against workpiece 60 that in turn rotates in the clockwise direction 62. A point closer to the center of workpiece 60 spends more time in contact with roller 61 than a point near the edge of workpiece 60. Therefore, a central point of workpiece 60 polishes faster than a peripheral point, unless the rotation rate of workpiece 60 adds significantly (e.g. becomes more than) to the polish rate from rotation of roller 61. A fixed workpiece rotation rate can result in a linear removal rate profile across most of workpiece 60 except at and around the center where extreme overpolish occurs because roller 61 always remains in contact with workpiece 60. To compensate for such overpolish, a portion of roller 61 can be removed, but with other problems associated with such a removal.

Moreover, U.S. Pat. No. 2,405,417 suggests that a workpiece 71 (FIG. 1D) can be mounted in a location away from the center C of a workpiece holding wheel 70, and rotated in a direction 73, while roller 72 spins in direction 74 along an axis perpendicular to the axis of direction 72. Location of roller 72 at such an off center location of workpiece holding wheel 70 can eliminate the center overpolish problem described above.

Workpiece 71 can be rotated by wheel 70 at relatively high speeds as compared to the rotational speed of roller 72, to accomplish a linear removal rate profile across workpiece 71. However, as the rotation speed of workpiece holding wheel 70 is increased, roller 72 may hydroplane on a polishing slurry typically present between roller 72 and workpiece 71. Moreover, at high rotational speeds of workpiece holding wheel 70, the polishing slurry may be thrown from the surface of workpiece 71, thereby causing nonuniformity in the removal rate profile across workpiece 71.

U.S. Pat. Nos. 653,531, 1,899,463, 2,536,444, 2,405,417, 3,748,677, 4,256,535, 4,910,155, 4,934,102 and 5,274,960 describe polishing machines similar to those discussed above.

SUMMARY OF THE INVENTION

In accordance with this invention, a first structure is rotatable about a first axis, and a second structure is rotatable about a second axis parallel to and laterally removed from the first axis such that when viewed in a direction parallel to the first axis, peripheral points on the first structure and the second structure define a first circle and a second circle respectively that overlap in an overlap area located between the first axis and the second axis. Within the overlap area, the slowest point of the first structure is overlapped by the fastest point of the second structure. So, the relative velocity across a workpiece mounted on one of the two structures is uniform during polishing if the speed of the first structure is matched (i.e. equal) to the speed of the second structure, regardless of the actual speed.

Equal velocity at all workpiece points that are overlapped by a polisher results in substantially improved removal uniformity (e.g. same amount of material removal across the workpiece). Moreover, as the two structures rotate at the same angular speed, the removal rate can be increased by increasing the speed at which the two wheels rotate. Also, use of the same angular speed for both structures eliminates the above discussed prior art problems of hydroplaning, throwing of polishing slurry from the workpiece, and "diving" of the workpiece into the polisher.

In one specific embodiment, the first structure is a workpiece holder, such as a substantially circular workpiece-holding platen with one or more indentations deep enough for a semiconductor wafer or other workpiece to be held for polishing. The second structure is a workpiece polisher, such as a polishing platen that includes a circular polishing pad.

In an alternate embodiment, the workpiece polisher is a cylindrical roller that spins about a longitudinal axis of the roller, and also rotates about a lateral axis perpendicular to the longitudinal axis. A uniform relative velocity across a workpiece is obtained when the roller rotates about the lateral axis at the same speed and in the same direction as the workpiece-holding platen. Spinning the roller about the longitudinal axis adds to the material removal rate caused by the above discussed relative velocity due to rotation of the roller about the lateral axis and rotation of the workpiece-holding platen.

DETAILED DESCRIPTION

Figure 1A:
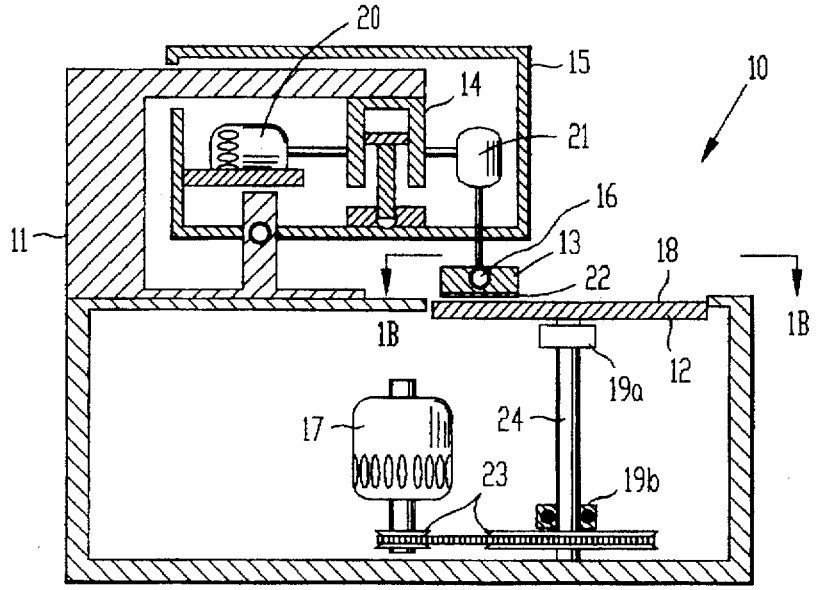
FIG. 1A (Prior Art)
FIGS. 1A and 1B illustrate respectfully, a cross-sectional side view and a plan view of a prior art polishing machine.
Figure 1B:
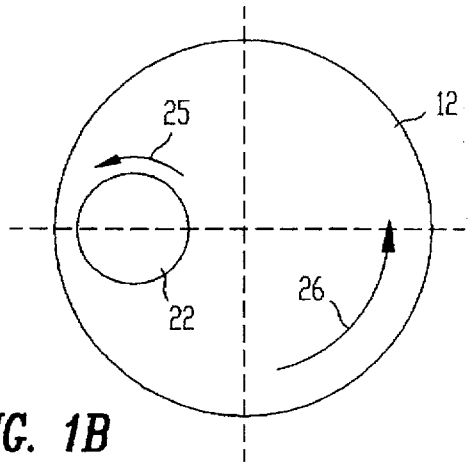
FIG. 1B (Prior Art)
Figure 1D:
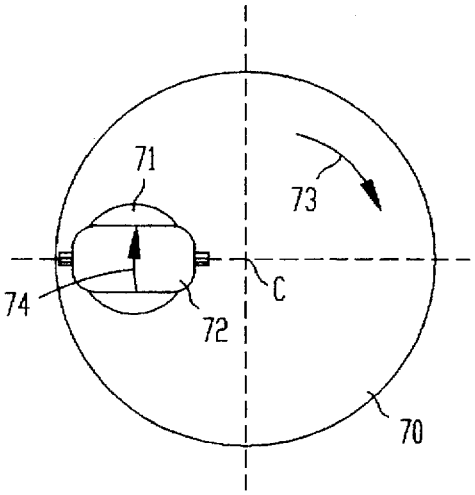
FIG. 1D (Prior Art)
FIGS. 1C and 1D illustrate in plan view, two prior art polishing machines that use a roller.
Figure 1C:
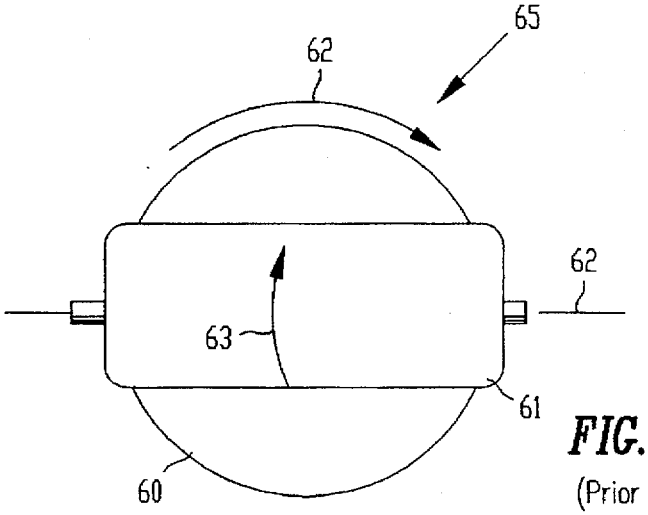
FIG. 1C (Prior Art)

In accordance with this invention, a first structure, such as first wheel 81 (FIG. 2) is rotatable about a point 84, and a second structure, such as second wheel 80 is rotatable about another point 86, such that first wheel 81 and second wheel 80 overlap in an overlap area 88. First wheel 81 (FIG. 2) rotates in a first direction 82, and second wheel 80 rotates in a second direction 83 that is identical to first direction 82. Directions 82 and 83 can both be, for example, the clockwise direction (as illustrated in FIG. 2), or alternatively, can both be the counterclockwise direction.

Within overlap area 88, the slowest point of first wheel 81 is overlapped by the fastest point of second wheel 80. Therefore, the relative velocity across a workpiece is uniform (i.e. same and not variable or varying) within overlap area 88, when the speed of first wheel 81 is matched to the speed of second wheel 80, regardless of the actual speed.

Figure 2:
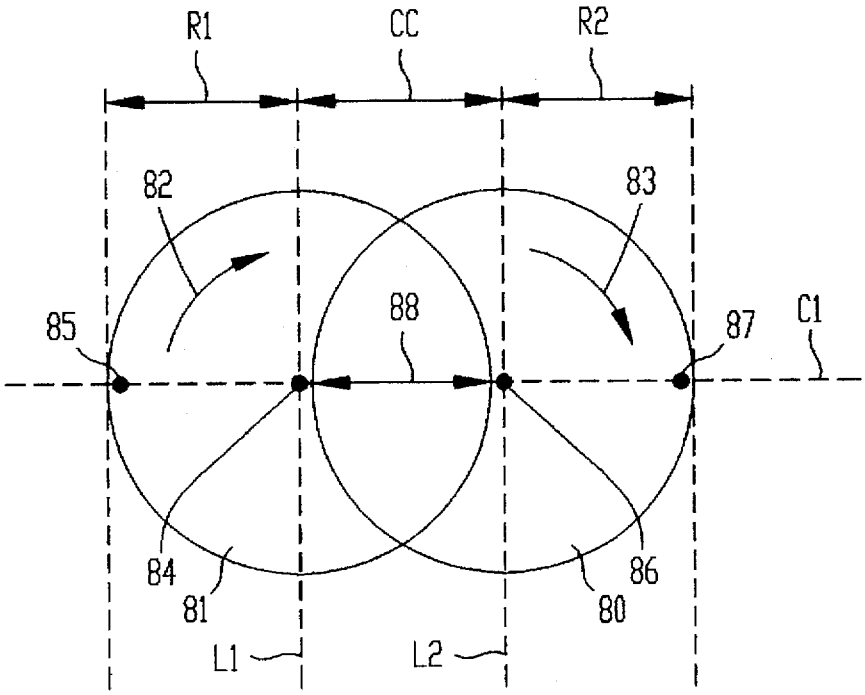
FIG. 2 illustrates two wheels that overlap in an overlap area, wherein the slowest point of the first wheel is overlapped by the fastest point of the second wheel in accordance with the invention.

In the specific embodiment illustrated in FIG. 2, overlap area 88 is bounded by a first line L1 and a second line L2. Lines L1 and L2 pass through points 84 and 86 respectively perpendicular to a central line C1 passing through points 84 and 86. Also, in FIG. 2, a point 85 located near the edge of first wheel 81 is at a first radius R1 from first location 84, wherein first radius R1 is equal to a center-to-center distance CC between first location 84 and second location 86. Similarly, a peripheral point 87 near the edge of second wheel 80 is at a second radius R2 from second location 86, wherein the second radius R2 also approximately equal to distance CC.

Although first wheel 81 and second wheel 80 are illustrated as having approximately the same radius, e.g. R1=R2, in other embodiments, one wheel can be larger than the other wheel. In one embodiment, a first wheel 81 (such as a polishing platen) is offset from the center location 86 of a second wheel 80 (such as a workpiece holder) by a distance greater than or equal to the radius of the largest of either the first wheel 81 or the second wheel 80, i.e. distance CC (FIG. 2) is greater than or equal to the largest of R1 and R2.

In another embodiment, a center wheel 90 (FIG. 3) is capable of holding four wafers, **98*a*–98*d* (wafer 98*d* is not shown) and revolves in a first direction 97 (such as the clockwise direction) about an axis through second location 96. A first polishing wheel 89 revolves about an axis through first location 94 in direction 92 that is identical to direction 97, and overlaps center wheel 90 in a manner similar to that described above in reference to FIG. 2. Moreover, a second polishing wheel 91 is located on an adjacent side of center wheel 90, for example, diametrically opposite to first polishing wheel 89 on a center line C2 that passes through locations 94 and 96. When center wheel 90 rotates, wafers 98*a*–98*d* move under first polishing wheel 89 and second polishing wheel 91**, and are polished.

When the speeds of all three wheels 89, 90 and 91 match, the velocity along the surfaces of any of wafers **98*a*–98*d* is always equal at any given point on the wafer. In view of the enclosed disclosure, it is obvious that uniform polishing occurs even without the presence of second polishing wheel 91. Second polishing wheel 91 is optionally added to increase the polish rate of wafers 98*a*–98*d*. If the size of each of wheels 89–91 is reduced, while the distances between the respective axes L1', L2' and L3' of wheels 89–91 remain unchanged, additional polishing wheels can be added around center wheel 90, although the actual useful equal velocity overlap area would be significantly reduced from the overlap area 88 (FIG. 2) obtained when wheels 89–91** have the same radius.

Figure 3:
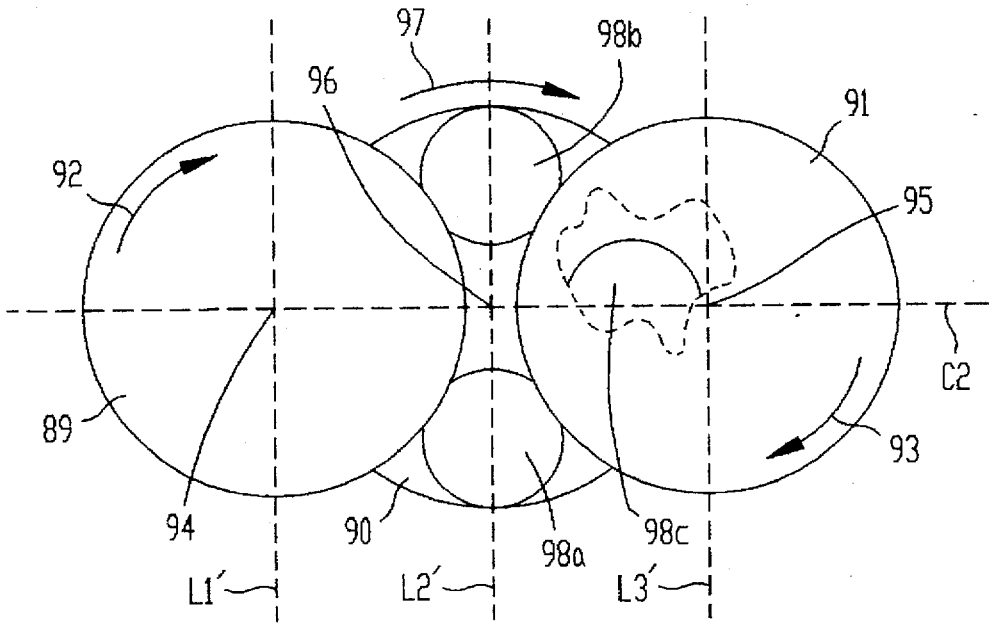
FIG. 3 illustrates a wafer holding wheel overlapped by two wafer polishing wheels in one embodiment of this invention.

As shown in FIG. 3, wafers **98*a*–98*d* are mounted at the periphery of center wheel 90. In the specific embodiment illustrated in FIG. 3, the surface of a wafer, e.g. one of wafers 98***a*–98*d* is completely enclosed within an overlap area when the wafer is located along center line C2. For example, wafer 98*c*, when located on center line C2 between locations 95 and 96 (as shown by the broken line in FIG. 3) is completely overlapped by second polishing wheel 91.

BEST MODE #1: EQUAL VELOCITY POLISHING WHEEL

Figure 4A:
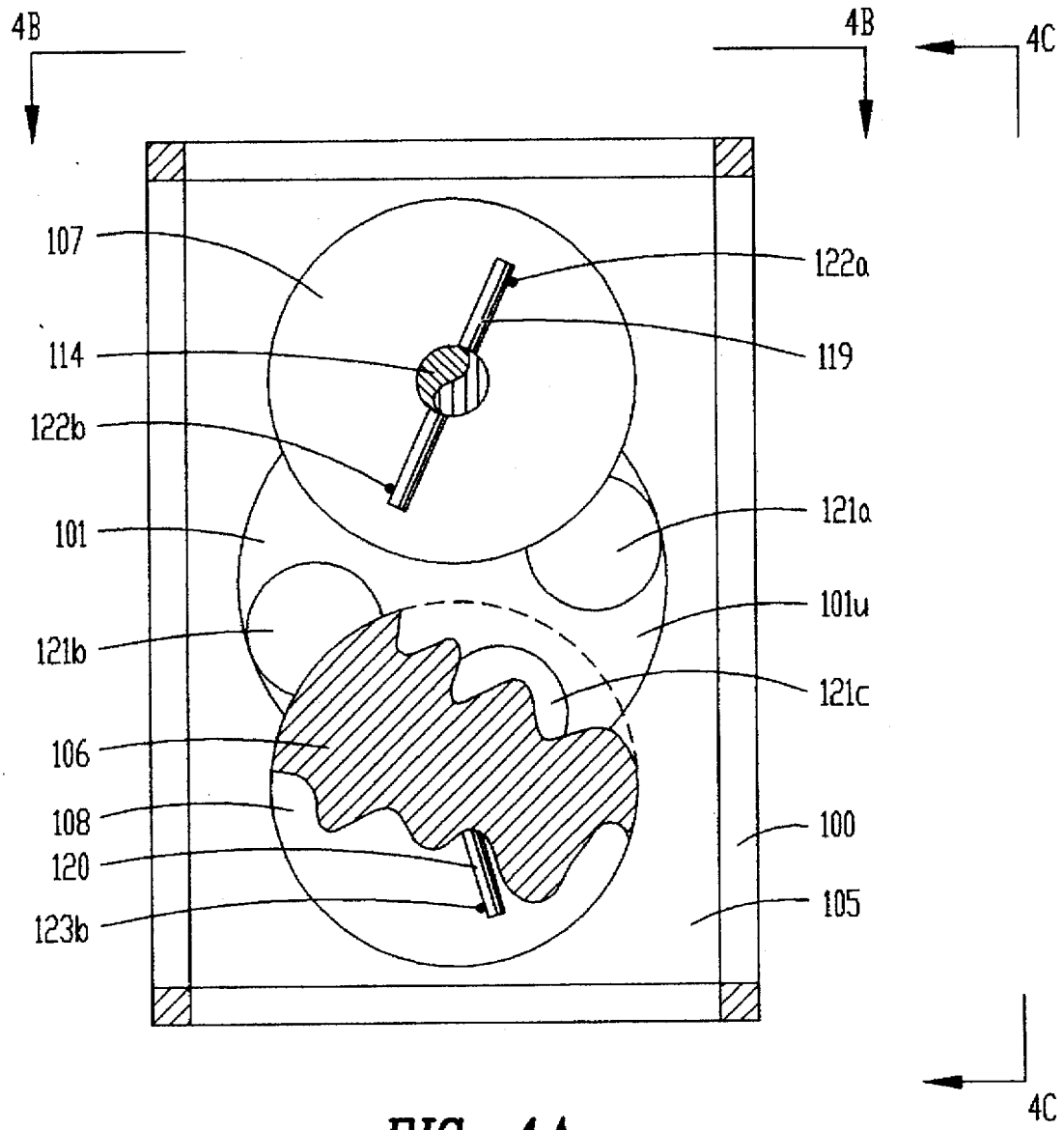
FIGS. 4A–4C illustrate in plan, front and side views of one specific embodiment of a polishing machine based on the three wheel arrangement illustrated in FIG. 3.

In one embodiment of this invention, a polishing machine (FIG. 4A) uniformly polishes wafers 121*a*–121*d* (wafer 121*d* is not visible in FIG. 4A) that are held in indentations (not shown) in an upper surface 101U of a platen 101. The indentations, also called "shallow depressions" in platen 101 are deep enough to allow a semiconductor wafer or other workpiece to be held for polishing. Platen 101 rotates wafers 121*a*–121*d* at the same speed as two polishing wheels 108 and 107 that carry polishing pads, such as polishing pad 106 affixed to polishing wheel 108. Polishing wheel 108 is illustrated in FIG. 4A in a cross-sectional view showing polishing pad 106 and an underlying wafer 121*c*. A shaft 114 drives a pin 119, and pin 119 turns against pins 122*a* and 122*b*, imparting rotational motion to polishing wheel 107. The pin arrangement of pins 120 and 123*b* serves a similar purpose for polishing wheel 108.

Figure 4B:
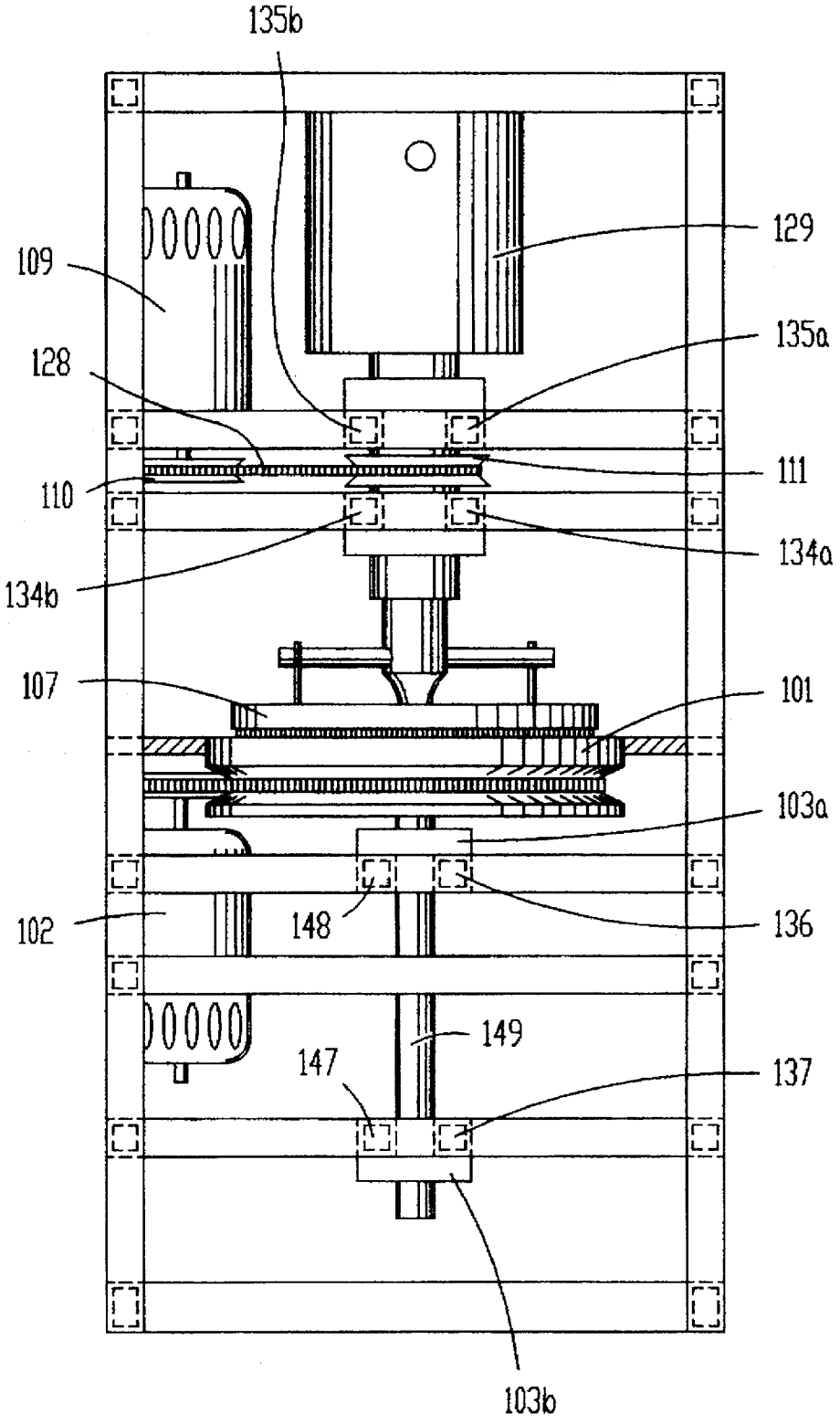
Figure 4C:
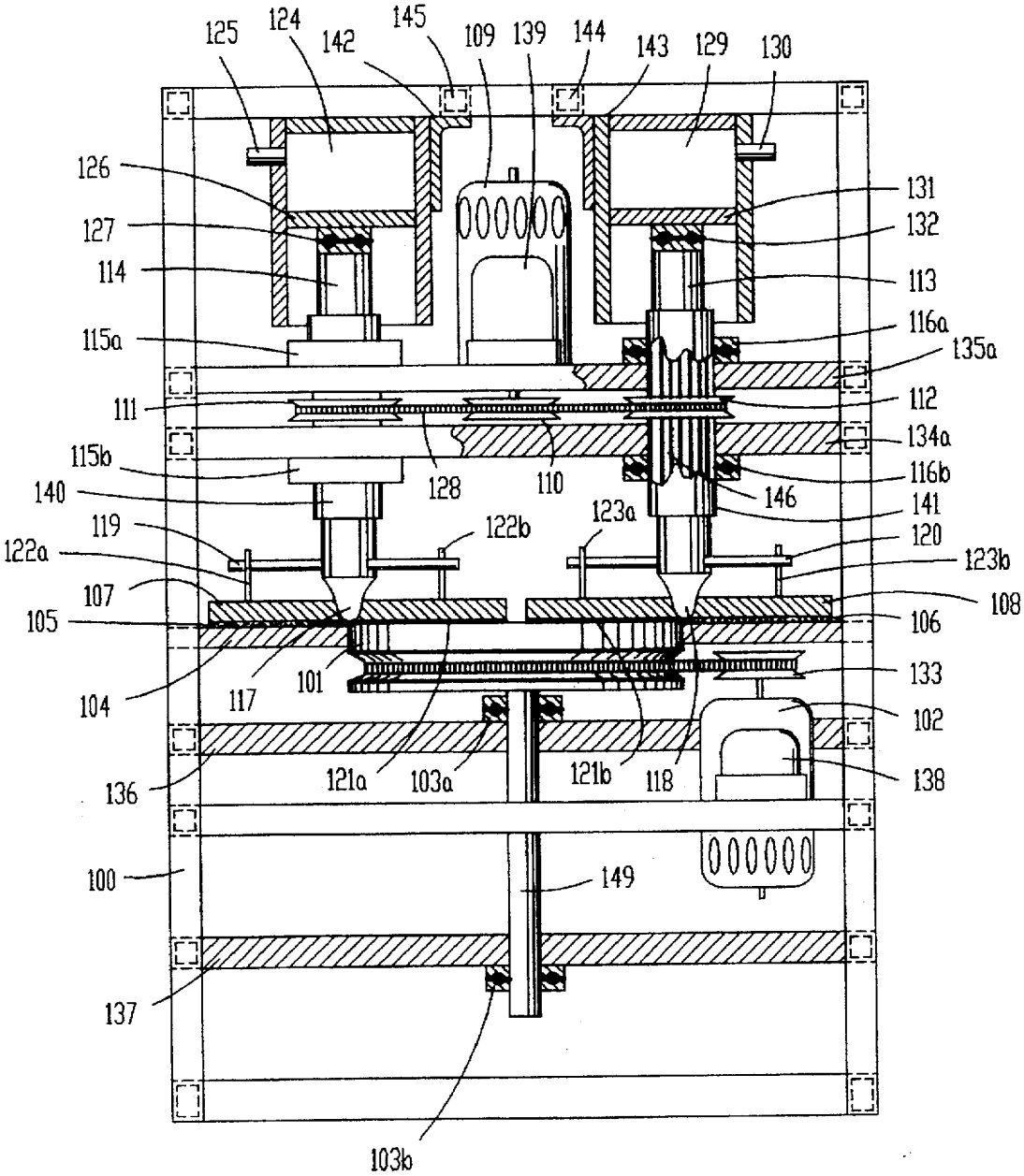

The polishing machine of FIGS. 4A–4C also includes a motor 109 (FIG. 4B) that drives polishing wheels 107 and 108 (FIG. 4A) using a belt 128 and three pulleys 110, 111 and 112 (FIG. 4C). Motor 109 is mounted to external framing 100 by bracket 139 (FIG. 4C). Shafts 114 and 113 are stabilized by respective pairs of bearings 115*a*, 115*b* and 116*a* and 116*b* (shown in cross-section in FIG. 4C) that are mounted on internal framing 134*a* and 135*a*. Polishing wheels 107 and 108 pivot on ball joints 117 and 118 respectively.

Forces that are necessary for polishing wheels 107 and 108 to polish wafers 121*a*–121*d* are supplied by air cylinders 124 and 129 respectively that include air inlet and exhaust ports 125 and 130 respectively and pistons 126 and 131 respectively. Air cylinders 124 and 129 are mounted to internal framing 145 and 144 respectively by brackets 142 and 143 respectively. Bearings 127 and 132 allow rotation of shafts 114 and 113 respectively, without transfer of the rotational motion to pistons 126 and 131 respectively. Sleeves 140 and 141 (sleeve 141 shown in cross-section with splines 146) allow shafts 114 and 113 respectively to slide vertically when a downward force is applied by air cylinders 124 and 129 respectively.

Platen 101 that holds wafers 121*a*–121*d* is rotated about a shaft 149 by a belt 133 driven by motor 102. Motor 102 is mounted by a bracket 138 to external framing 100. Shaft 149 is stabilized by bearings 103*a* and 103*b* that are mounted on internal framing 136 and 137 respectively. Platen 101 is surrounded by a working surface 104 that is secured by external framing 100. Working surface 104 can be covered with a low friction material 105, such as TEFLON, that offers less friction than working surface 104. Platen 101 is also coated with a low friction material (not shown).

BEST MODE #2: EQUAL VELOCITY POLISHING ROLLER

Instead of polishing wheels 107 and 108 (FIGS. 4A–4C), a polishing machine can have polishing rollers 250 (FIG. 5A) and 213 (FIG. 5B) that spin about their longitudinal axes. Polishing rollers 250 and 213 are also rotated by shafts 245 and 228 (FIG. 5A) that are driven by belt 230 in turn driven by a motor 229 through pulleys 246 and 231. Rollers 250 and 213's spinning motion and the rotation by shafts 245 and 228 together still provide a relative velocity profile that is equal across overlapping points of wafers 254*a*–254*d* held by platen 201.

Polishing rollers 213 and 250 are rotated (i.e. spun) about their longitudinal axes by the respective motors 217 and 237 through the respective differentials 218 and 238, shafts 219 and 239 (FIG. 5B), and differentials 210 and 240. For example, differential 218 drives shaft 219 that drives differential 210 (shown partly in cross-section exposing an inner gear train) that in turn drives shaft 220 that rotates on bearings 221 and 222. Polishing rollers 213 and 250 are supported by internal framing 214–216 and 235–236 and 252 respectively.

In one specific embodiment, rollers 213 and 250 are inflated by pressurized air or pressurized fluid that enters at inlet tubings 226 and 246 and is transferred via slip rings 242, 244 and tubes (not shown) within rotating shafts 228 and 245 to polishing rollers 213 and 250. On inflation of rollers 213 and 250 by the pressurized fluid, rollers 213 and 250 exert a downward force on platen 201 to polish wafers 254*a*–254*d*. Shafts 228 and 245 are stabilized by bearings 232–233 and 247–248 that are secured by internal framing 255*a*–255*b*, 256*a*–256*b*, 257*a*–257*b* and 258*a*–258*b*. Two slip rings 249 and 227 are located at the top of shafts 245 and 228, and are used to transfer electrical power through rotating shafts 245 and 228 respectively to motors 237 and 217.

Platen 201 that holds wafers 254*a*–254*d* is substantially similar to platen 101 described above in reference to FIGS. 4A–4C. Platen 201 is also similarly driven by motor 202 mounted on frame 200 by bracket 203. Platen 201 is held by bearings 204A and 204B that are mounted to internal framings 206, 207 and 208, 209. The polishing machine of FIGS. 5A–5C also includes a working surface 211 that may be coated with a low friction material 212, such as TEFLON. A low friction material (not shown) also covers the surface of platen 201.

Figure 5A:
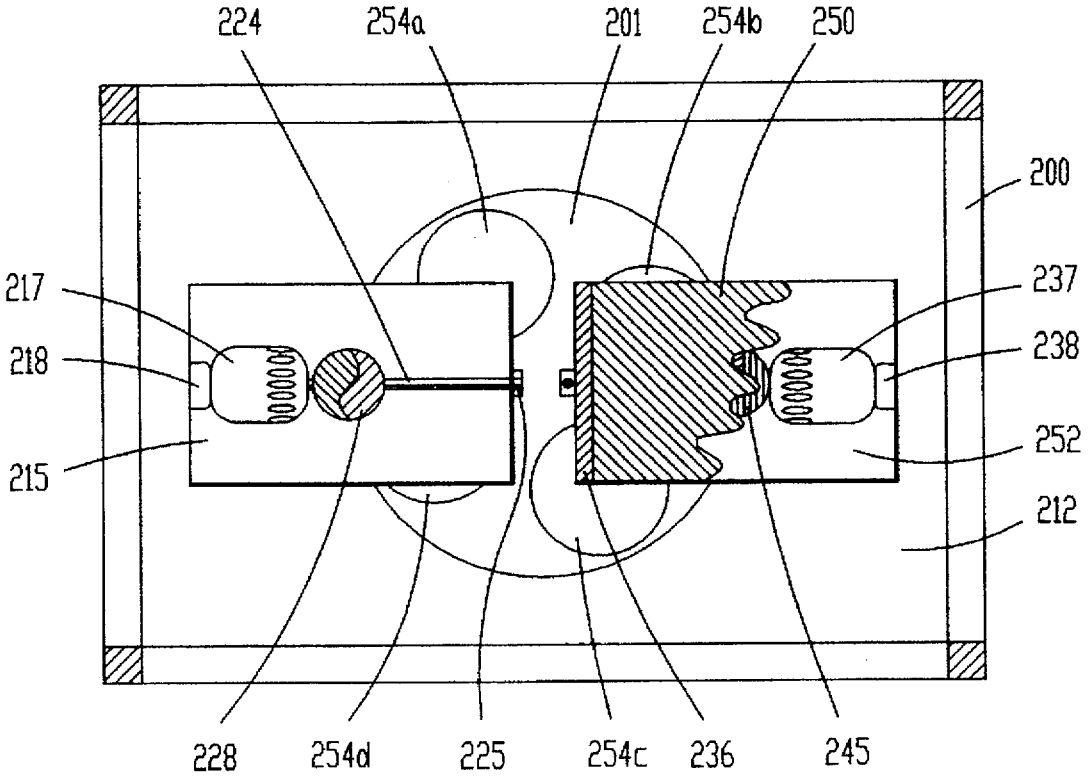
FIGS. 5A–5C illustrate in plan, front and side views respectively another embodiment of a polishing machine based on two rollers instead of the two polishing wheels of FIG. 3.
Figure 5B:
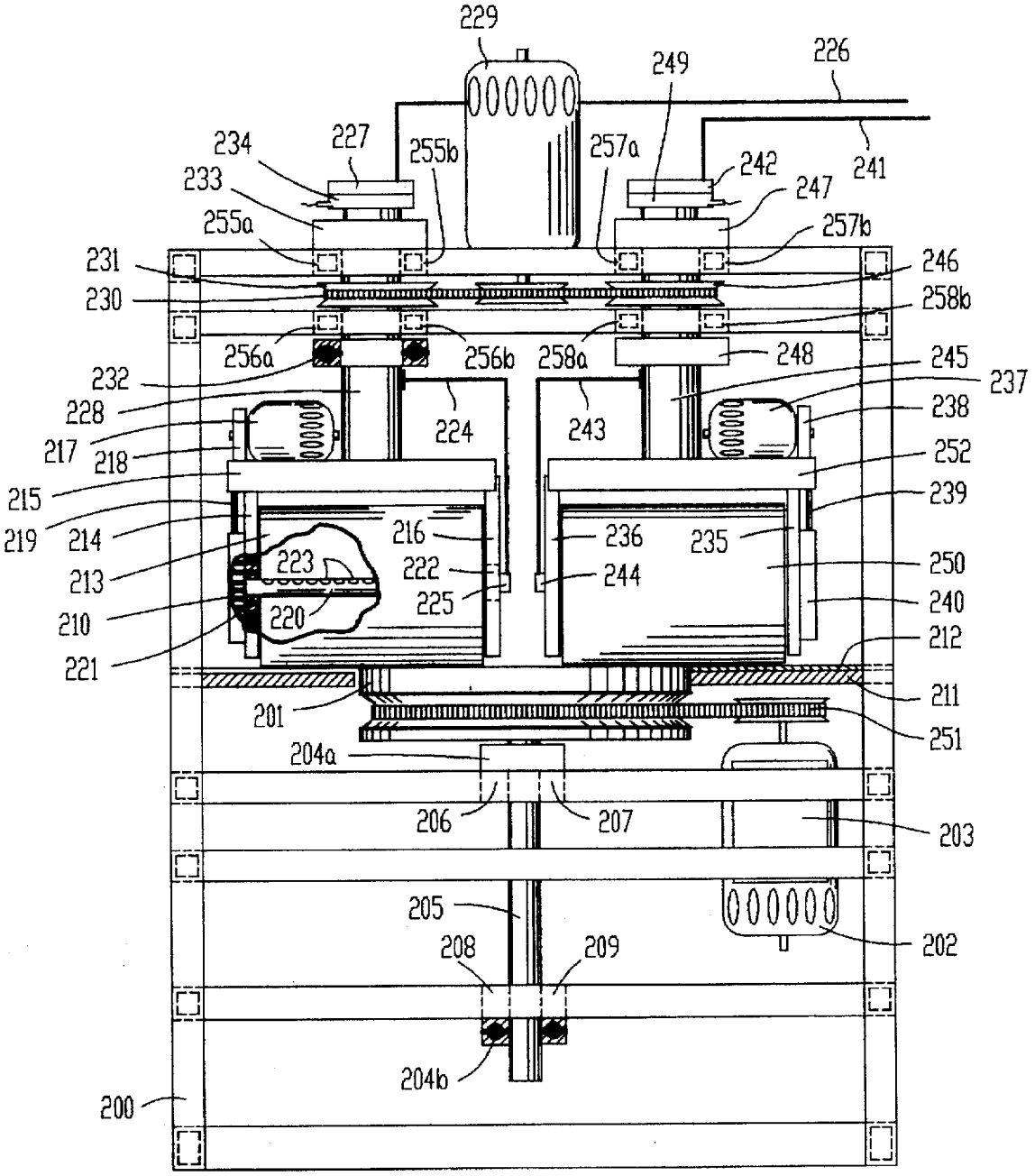
Figure 5C:
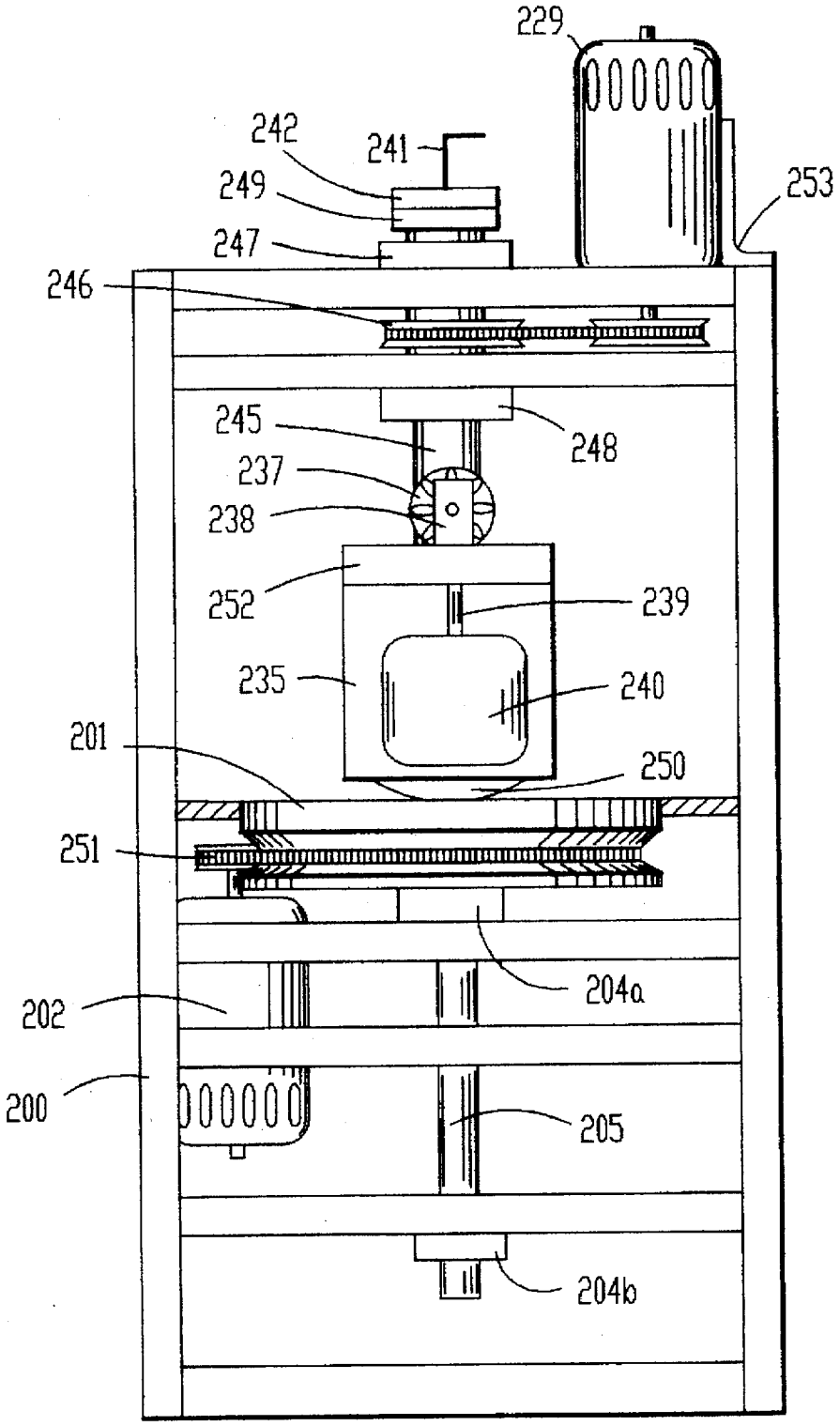

Moreover, in this embodiment as well, second polishing roller 250 is optional, (as compared to the first polishing roller 213), and is added to increase the abrasion rate and thus the throughput through the polishing machine of FIGS. 5A–5C.

ADVANTAGES OF INVENTION

Polishing machines in accordance with this invention have several advantages over prior art polishing machines. Specifically, polishing machines described herein use equal relative velocity at all locations overlapping a polisher to provide uniformity in the removal rate across one side of a workpiece, without reference to the other side of the workpiece. No known prior art designs for a single sided polishing machine accomplish such a uniform removal rate.

Moreover, as the workpiece and the polisher rotate at the same angular velocity, the prior art limit on the removal rate imposed by the need to use polisher speeds slower than workpiece speeds is eliminated. Also, in a polishing machine of this invention a workpiece holding platen holds workpieces in a more stable manner than in traditional wafer carriers. Furthermore, the polishing machines of this invention do not subject the workpieces to rapid twisting forces present in prior art polishing machines. Polishing machines in accordance with this invention can apply a greater downward force without the prior art problem of misalignment between a polishing arm and the polisher. Furthermore, the prior art problem of a wafer "diving" into the polisher is eliminated by use of a table as the workpiece holder.

The enclosed description does not limit the scope of the invention. Rather, certain preferred embodiments described herein are merely illustrative of the invention. Numerous modifications and variations will be obvious to a person of skill in the art of machine design in view of the enclosed disclosure. Accordingly, many variations are covered by the attached claims of this patent.

I claim:

1. A polishing machine for polishing a surface of a workpiece, said polishing machine comprising:

a workpiece holder rotatable about a first axis, said workpiece holder being capable of holding said workpiece, wherein during rotary motion of said workpiece holder with said workpiece held thereon, said workpiece rotates at a first angular velocity about said first axis;

a workpiece polisher rotatable about a second axis, said second axis being parallel to said first axis and laterally displaced therefrom such that when viewed in a direction parallel to one of said axes, a portion of a left side of said workpiece polisher overlaps a portion of a right side of said workpiece holder thereby to cause all points of said workpiece in said overlap area to have substantially equal relative velocity with respect to said workpiece polisher when said workpiece polisher rotates at approximately the same angular velocity as said workpiece; and means for forcing said workpiece polisher and said workpiece towards each other and for causing said workpiece surface to be polished during passage of said workpiece through said overlap area.

2. The polishing machine of claim 1 wherein said workpiece surface is completely overlapped by said portion of said left side of said workpiece polisher when said workpiece is located on a line through said first axis and said second axis.

3. The polishing machine of claim 1 wherein said workpiece holder comprises a substantially circular table.

4. The polishing machine of claim 1 wherein said workpiece polisher is circular and further wherein said workpiece holder is circular and has a diameter substantially equal to the diameter of said polishing pad.

5. The polishing machine of claim 1 wherein said workpiece polisher comprises a roller rotatable about a longitudinal axis and about a lateral axis perpendicular to said longitudinal axis, said lateral axis passing through said second location.

6. The polishing machine of claim 5 wherein said roller is inflatable by a pressurized fluid.

7. The polishing machine of claim 1 further comprising at least three electric motors, wherein a first electric motor provides rotary motion to said workpiece holder, a second electric motor provides rotary motion to said workpiece polisher and a third electric motor provides spinning motion to said workpiece polisher.

8. The polishing machine of claim 1 wherein said means for forcing and for causing comprises an air cylinder.

9. The polishing machine of claim 1 wherein said means for forcing and for causing comprises a polishing slurry.

10. The polishing machine of claim 1 wherein said workpiece holder and said workpiece polisher are both circular, and further wherein the distance between said first axis and said second axis is approximately equal to the radius of the largest of either said workpiece holder or said workpiece polisher.

11. An apparatus for polishing a surface of a workpiece, said apparatus comprising:

a first structure capable of holding a workpiece, said first structure being rotatable about a first center such that a first peripheral point of said first structure defines a first circle during rotary motion of said first structure;

a second structure capable of holding a polishing pad, said second structure being rotatable about a second center such that a second peripheral point of said second structure defines a second circle during rotary motion of said second structure, wherein said first circle overlaps said second circle to form an overlap area located only between a first straight line passing through said first center and a second straight line passing through said second center, said first straight line and said second straight line being parallel to each other and both lines being perpendicular to a center straight line passing through said first center and said second center; and means for forcing said workpiece and said polisher toward each other in a direction parallel to the first straight line, and for causing said workpiece surface to be polished uniformly at all points during contact with said polisher.

12. The polishing machine of claim 11 wherein the distance between said first center and said second center is greater than or equal to the radius of the largest of either said first circle or said second circle.

13. The polishing machine of claim 12 wherein said workpiece surface is completely enclosed within said overlap area when said workpiece is located between said first center and said second center on said center straight line.

14. The polishing machine of claim 12 further comprising a third structure rotatable about a third center such that a third peripheral point of said third structure defines a third circle during rotary motion of said third structure, wherein said first circle and said third circle overlap in another overlap area located only between said first straight line and a third straight line passing through said third center, said third line being parallel to said first straight line, and further wherein said third structure is capable of holding a polishing pad for polishing .said workpiece surface during passage of said workpiece through said another overlap area.

15. An apparatus for polishing a workpiece, said apparatus comprising:

first means rotatable about a first center, said first means being capable of holding said workpiece;

second means rotatable about a second center removed from said first center, said second means being capable of holding a polisher for polishing said workpiece, a portion of said first means overlapping a portion of said second means in an overlap area such that on rotation of each of said first means and said second means at the same angular velocity, the relative velocity between said polisher and said workpiece is substantially uniform at all points of said workpiece in said overlap area.

16. The polishing machine of claim 15 wherein a peripheral point on each of said first means and said second means describes a first circle and a second circle respectively and further wherein the distance between said first center and said second center is greater than or equal to the radius of the largest of either said first circle or said second circle.

17. The polishing machine of claim 16 wherein said workpiece surface is completely overlapped by said polisher when said workpiece is located on a straight line between said first center and said second center.

18. The polishing machine of claim 15 wherein said second means comprises a roller rotatable about both a longitudinal axis and a lateral axis perpendicular to said longitudinal axis, said lateral axis passing through said second center.

19. The polishing machine of claim 18 wherein said roller is inflatable by a pressurized fluid.

20. The polishing machine of claim 15 further comprising at least three electric motors, wherein a first electric motor provides rotary motion to said first means, a second electric motor provides rotary motion to said second means and a third electric motor provides spinning motion to said second means.

21. The polishing machine of claim 15 further comprising third means rotatable about a third point removed from said first point, said third means being capable of holding another polisher for polishing said workpiece, wherein on rotation of each of said first means, said second means and said third means at a predetermined angular velocity, the relative velocity across said workpiece is uniform at points of said workpiece overlapping said polisher or overlapping said another polisher.

22. The polishing machine of claim 15 wherein during said rotation, the slowest point among overlapping points on said workpiece is overlapped by the fastest point among overlapping points on said workpiece polisher.

23. A method for polishing a workpiece, said method comprising the steps of:

mounting a workpiece holder at a first point and a workpiece polisher at a second point removed from said first point; and rotating each of said workpiece holder and said workpiece polisher at approximately the same angular velocity such that the relative velocity across a workpiece held by said workpiece holder is substantially uniform at each point of said workpiece overlapping said workpiece polisher.

24. The method of claim 23 wherein during said mounting step the workpiece holder and the workpiece polisher are mounted at a distance from each other, said distance being approximately equal to the radius of the largest of either said workpiece holder or said workpiece polisher.

25. The method of claim 23 wherein during said rotation step said workpiece surface is completely enclosed within an overlap area between said workpiece holder and said workpiece polisher when said workpiece is located in line between said first point and said second point.

26. The method of claim 23 wherein during said rotation step the slowest point among overlapping points on said workpiece is overlapped by the fastest point among overlapping points on said workpiece polisher.

27. The method of claim 23 wherein said mounting step comprises mounting a plurality of polishers.

28. A polishing machine for polishing a surface of a workpiece, said polishing machine comprising:

a workpiece holder rotatable about a first axis, said workpiece holder being capable of holding said workpiece, wherein during rotary motion of said workpiece holder with said workpiece held thereon, said workpiece rotates at a first angular velocity about said first axis;

a workpiece polisher rotatable about a second axis, said second axis being parallel to said first axis and laterally displaced therefrom such that when viewed in a direction parallel to one of said axes, a portion of a right side of said workpiece polisher overlaps a portion of a left side of said workpiece holder thereby to cause all points of said workpiece in said overlap area to have substantially equal relative velocity with respect to said workpiece polisher when said workpiece polisher rotates at approximately the same angular velocity as said workpiece; and means for forcing said workpiece polisher and said workpiece towards each other and for causing said workpiece surface to be polished during passage of said workpiece through said overlap area.

29. The polishing machine of claim 28 wherein said workpiece surface is completely overlapped by said portion of said right side of said workpiece polisher when said workpiece is located on a line through said first axis and said second axis.

30. The polishing machine of claim 28 wherein said workpiece polisher comprises a roller rotatable about a longitudinal axis and about a lateral axis perpendicular to said longitudinal axis, said lateral axis passing through said second location.

31. The polishing machine of claim 28 wherein said workpiece holder and said workpiece polisher are both circular, and further wherein the distance between said first axis and said second axis is approximately equal to the radius of the largest of either said workpiece holder or said workpiece polisher.

* * * * *